US007114995B1

(12) United States Patent
Ohshima

(10) Patent No.: US 7,114,995 B1
(45) Date of Patent: Oct. 3, 2006

(54) MODULAR JACK

(75) Inventor: Shinobu Ohshima, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/414,358

(22) Filed: May 1, 2006

(30) Foreign Application Priority Data

May 30, 2005 (JP) ..... 2005-157118

(51) Int. Cl.
*H01R 13/64* (2006.01)
*H01R 24/00* (2006.01)

(52) U.S. Cl. ..... 439/680; 439/677

(58) Field of Classification Search ..... 439/674, 439/676, 677, 680
See application file for complete search history.

(56) References Cited

U.S. PATENT DOCUMENTS 6,186,835 B1 * 2/2001 Cheshire ..... 439/676
6,273,761 B1 * 8/2001 Hsu et al. ..... 439/676
6,296,528 B1 * 10/2001 Roberts et al. ..... 439/676
6,354,884 B1 * 3/2002 Yeh et al. ..... 439/680

FOREIGN PATENT DOCUMENTS

JP 2002-313492 10/2002

* cited by examiner

*Primary Examiner*—Tho D. Ta
(74) *Attorney, Agent, or Firm*—Wenderoth, Lind & Ponack, L.L.P.

(57) ABSTRACT

To reduce number of parts and reduce cost in a multi-pin modular jack provided with a mis-insertion prevention mechanism that prevents insertion of a modular plug having number of pins different from the modular jack the mis-insertion prevention mechanism includes a mis-insertion determination unit having a mis-insertion prevention guide mounted at the front that causes a modular plug having different number of pins from the modular jack inserted into an opening in a housing of the modular jack to move traversely and an elastic support mounted at the rear and fixedly supported at the rear of the housing, and a stopper formed on a portion of the roof of the housing on a side opposite the side on which the mis-insertion determination unit. The mis-insertion determination unit is disposed on either an upper left or an upper right top part inside the opening in the housing.

2 Claims, 7 Drawing Sheets

MODULAR JACK

BACKGROUND OF THE INVENTION

1. Field of the Invention

The present invention relates to a multi-pin modular jack provided with a mis-insertion prevention mechanism that prevents insertion of a modular plug having a number of pins different from a predetermined number of pins.

2. Related Art

Conventionally, there is a modular jack and a modular plug used to connect internal telephone lines, LAN (Local Area Networks) and the like, which are termed 6-pin types and 8-pin types because of the difference in the number of pins they have. Although the two types differ in the number of pins, the pins are mounted at the same pitch. Consequently, although it is physically impossible to insert an 8-pin modular plug into a 6-pin modular jack because of the difference in size, conversely it is possible for a 6-pin modular plug to be mistakenly inserted into an 8-pin modular jack. In order to prevent the mis-insertion of a plug into a different type of jack for which the plug is not suited, there is known an arrangement in which the modular jack is equipped with a stopper member that comes into play when a plug of a different number of pins in inserted into the jack (for example, JP-A-2002-313492).

However, with this type of conventional modular jack, the stopper member of the mis-insertion prevention mechanism that prevents mis-insertion of a modular plug of a different type consists of two stoppers provided left and right, which increases the number of parts and thus increases the cost of the modular jack.

SUMMARY OF THE INVENTION

The modular jack according to the present invention is proposed to solve the above-described problem of the conventional modular jack, reducing the number of parts and thereby reducing the cost of the modular jack.

To achieve the above-described objects, the present invention provides a modular jack having a mis-insertion prevention mechanism that prevents insertion of a modular plug having a number of pins other than a predetermined number of pins, wherein the mis-insertion prevention mechanism including a mis-insertion determination unit and a stopper, the mis-insertion determination unit having a mis-insertion prevention guide mounted at the front of the mis-insertion determination unit that causes a modular plug having a different number of pins from the modular jack inserted into an opening in a housing of the modular jack to move traversely and an elastic support mounted at the rear of the mis-insertion determination unit that is fixedly supported at the rear of the housing of the modular jack, the mis-insertion determination unit being disposed on either an upper left or an upper right top part inside the opening in the housing of the modular jack, the stopper being formed on a portion of the roof of the housing on a side opposite the side on which the mis-insertion determination unit is disposed in a lateral direction of the opening, so that the mis-insertion prevention mechanism prevents advance of a modular plug having a different number of pins from the modular jack mistakenly inserted into the opening in the housing of the modular jack beyond a point at which a portion of the modular plug contacts the stopper.

Preferably, a slanted surface is formed on a lower part of the tip of the mis-insertion prevention guide that allows the mis-insertion prevention guide to retreat upward when a modular plug having a predetermined number of pins is inserted into the housing of the modular jack and an upper part of a tip thereof slidingly contacts the mis-insertion prevention guide, and a traverse movement-inducing part is formed on a lateral surface of the mis-insertion prevention guide that slants inward toward the center of the housing of the modular jack in a latitudinal direction so as to slidingly contact the tip of a modular plug having a different number of pins from the modular jack mistakenly inserted into the modular jack against the stopper.

According to the modular jack of this invention, it combines the elastic support and the mis-insertion prevention guide of the mis-insertion determination unit that is separate from the modular jack so as to form a single component, one which can simply be provided at either an upper left or an upper right edge inside the opening in the housing of the modular jack, thereby reducing the number of parts and thus reducing the cost of the modular jack.

Other objects, features and advantages of the present invention will be apparent from the following description when taken in conjunction with the accompanying drawings, in which like reference characters designate the same or similar parts throughout the figures thereof.

DETAILED DESCRIPTION OF THE PREFERRED EMBODIMENTS

A detailed description will now be given of a preferred embodiment of the present invention, with reference to the accompanying drawings.

Figure 1A:
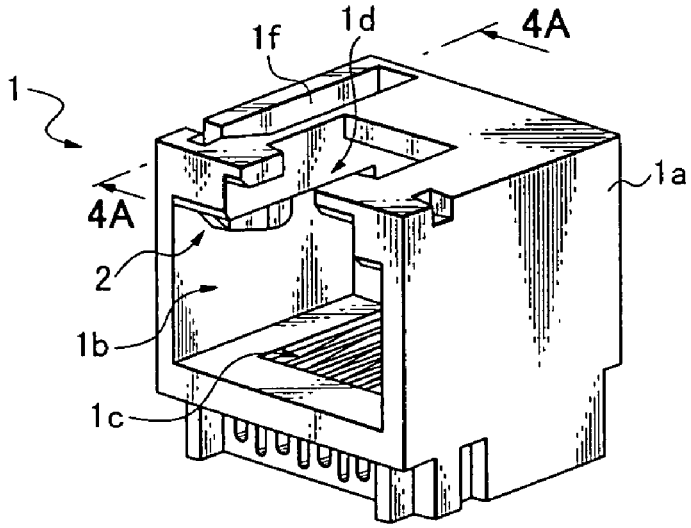
FIGS. 1A, 1B and 1C are upper right front, lower right front and lower left front perspective views, respectively showing the modular jack according to the present invention.
Figure 1B:
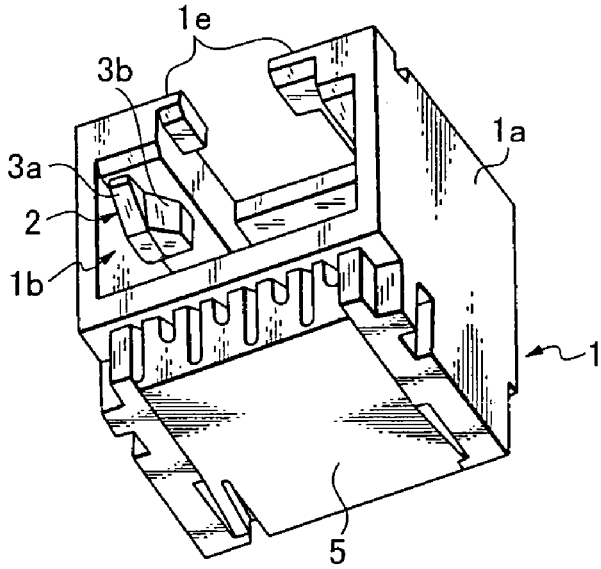
Figure 1C:
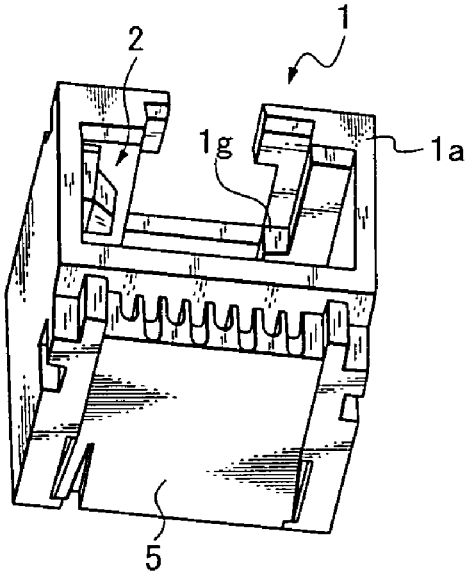

As shown in FIGS. 1A–1C, a modular jack 1 according to one embodiment of the present invention is an 8-pin jack having a rectangular box-like housing 1*a* made of synthetic resin with a large opening 1*b* in the front. A mis-insertion determination unit 2 for preventing the insertion of a modular plug other than one having 8 pins, for example, a 6-pin or a 4-pin modular plug, is provided at an upper left corner of the rectangular space inside the housing 1*a*.

The opening 1*b* in the housing 1*a* is wide, and shaped to fit the end of the plug to be inserted therein. A contact assembly 1*c* for electrically connecting the (8-pin) modular plug to be inserted is disposed on the floor of the interior of the housing 1*a*.

Further, an engaging slot 1*d* is formed in the top of the housing 1*a*, with lateral projections 1*e* formed at the front of the engaging slot 1*d*. The lateral projections 1*e* engage an elastic catch provided on top of the inserted modular plug from the inside to prevent the modular plug from slipping out.

Figure 2:
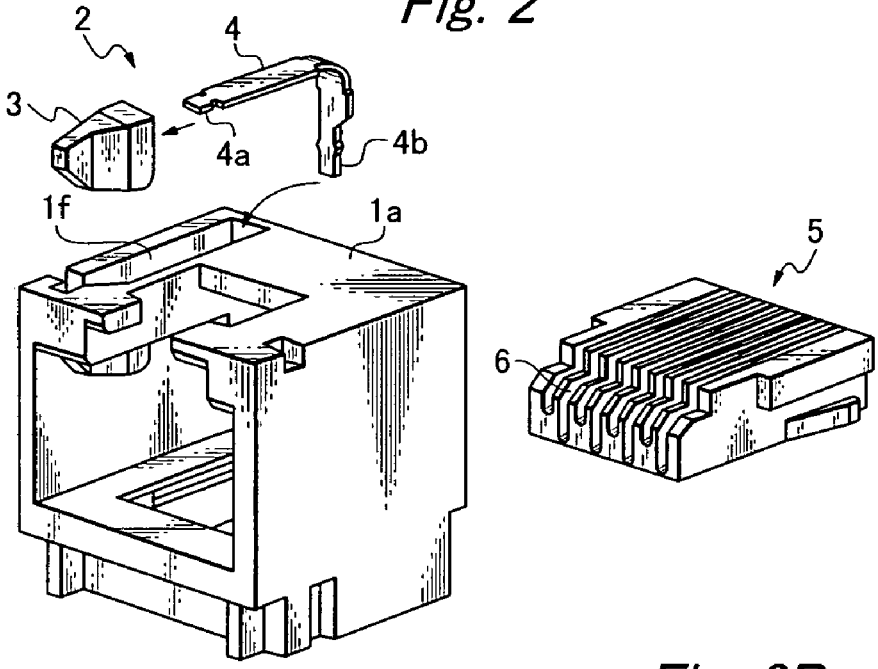
FIG. 2 is an exploded perspective view showing the modular jack.
Figure 3A:
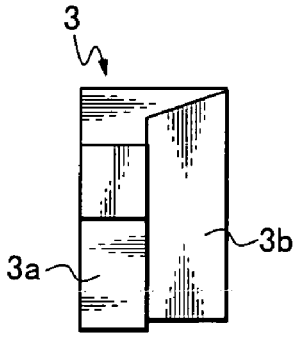
FIGS. 3A, 3B, 3C, 3D and 3E are front, right, plan, rear and perspective views, respectively showing a mis-insertion prevention guide of the modular jack.
Figure 3B:
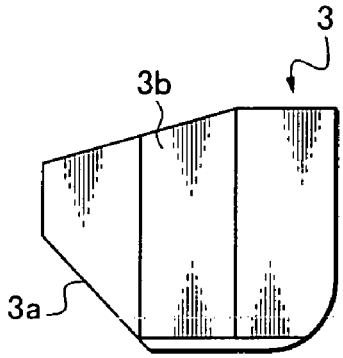
Figure 3C:
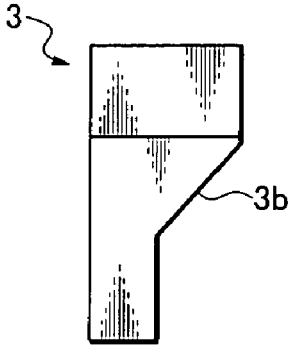
Figure 3D:
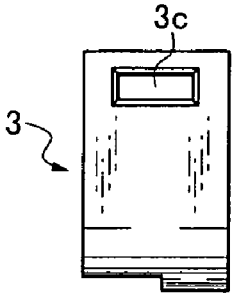
Figure 3E:
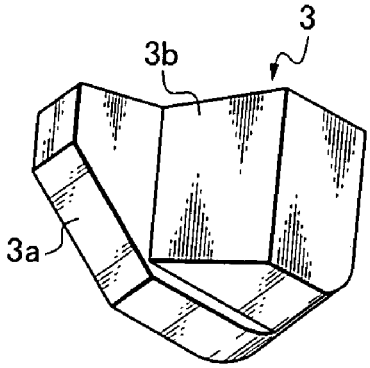

As shown in FIG. 2, the mis-insertion determination unit 2 is composed of a synthetic resin mis-insertion prevention guide 3, which forms a mis-insertion determination member, and a metallic L-shaped lever 4, which forms an elastic support, pressed into the mis-insertion prevention guide 3 from the rear to form a single unit therewith. As shown in FIG. 3D, an engagement slot 3*c* into which a tip portion 4*a* of the lever 4 is inserted is formed on the back of the mis-insertion prevention guide 3.

Figure 4A:
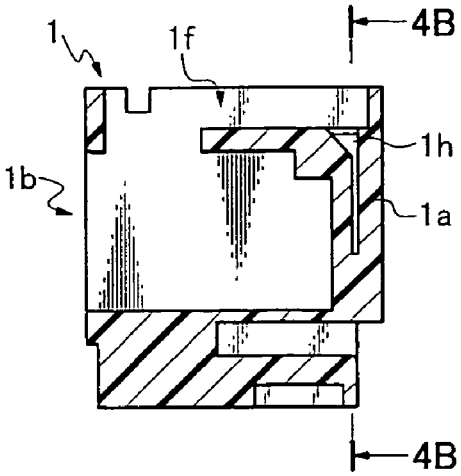
FIGS. 4A and 4B are sectional views of the modular jack along lines 4A—4A and 4B—4B shown in FIGS. 1A and 4A, respectively.
Figure 4B:
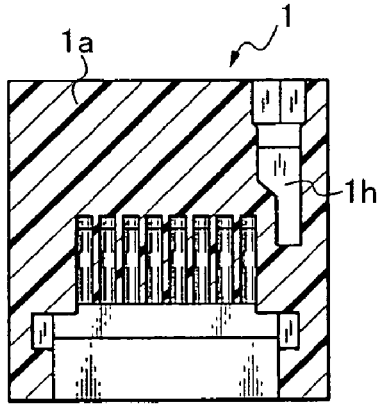

After the tip portion 4*a* of the lever 4 is inserted into the slot 3*c* and the lever 4 forms a single unit with the mis-insertion prevention guide 3, this unit is inserted into a slot 1*f* formed along one side of the roof of the housing 1*a*, with a rear portion 4*b* of the lever 4 inserted into an engagement slot 1*h* formed in the rear of the housing 1*a* and supported thereby (see FIGS. 4A, 4B).

As described above, the mis-insertion prevention guide 3 is mounted on the housing 1*a* by the lever 4 so as to project into the interior space of the housing 1*a* from the lower side of one edge of the roof of the housing 1*a* as shown in FIG. 1B. The mis-insertion prevention guide 3 as a whole forms the synthetic resin mis-insertion determination member. As shown in FIGS. 3A–3E, a slanted surface 3*a* is formed on the underside of the tip of the mis-insertion prevention guide 3 for allowing the mis-insertion prevention guide 3 to retreat upward when the correct (8-pin) modular plug is inserted into the modular jack 1, and a traverse movement-inducing part 3*b* is formed on a lateral surface of the mis-insertion prevention guide 3 for moving the modular plug to the right as shown in FIG. 1A when the wrong modular plug (that is, a modular plug other than an 8-pin modular plug) is inserted into the modular jack 1.

Figure 5A:
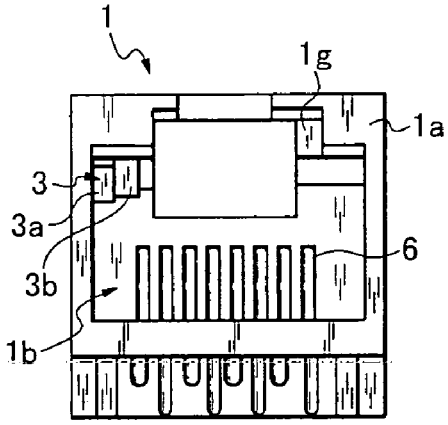
FIGS. 5A, 5B, 5C, and 5D are front, plan, bottom and left side views, respectively showing the modular jack.
Figure 5B:
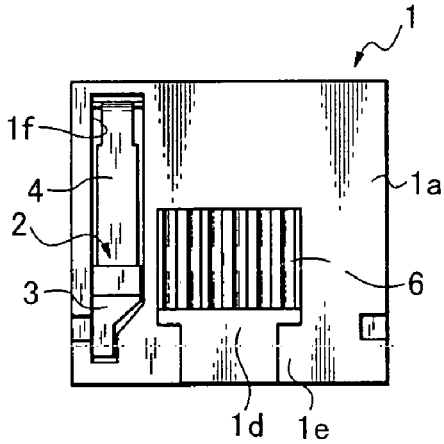
Figure 5C:
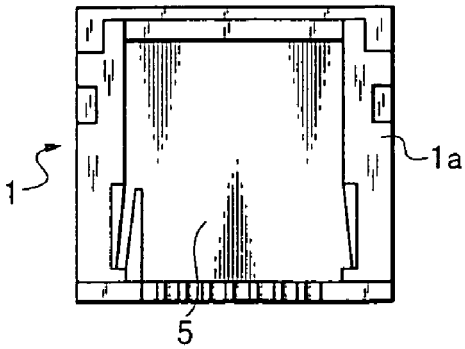
Figure 5D:
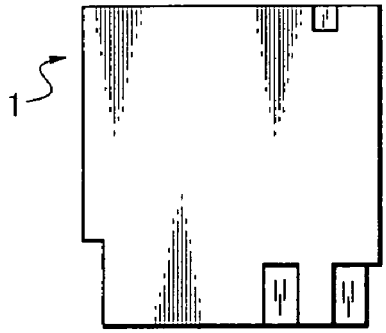

As shown in FIG. 1C and FIG. 5A, a portion of the roof portion of the housing 1*a* is removed and a stopper 1*g* is formed thereat. When a modular plug of the wrong number of pins for the modular jack 1 is inserted and moved traversely by the traverse movement-inducing part 3*b* of the mis-insertion prevention guide 3, the top corner of the tip of the plug contacts the stopper 1*g* and is stopped from advancing any further into the modular jack 1.

As shown in FIG. 2, the assembly of the modular jack 1 involves pushing that in which contacts 6 are assembled in advance on an insulator 5 into the bottom of the housing 1*a* from behind and inserting the mis-insertion determination unit 2 from the slot 1*f* so as to mount the mis-insertion determination unit 2 inside the housing 1*a* via the L-shaped lever 4 as described above (see FIGS. 5A–5D).

Figure 6A:
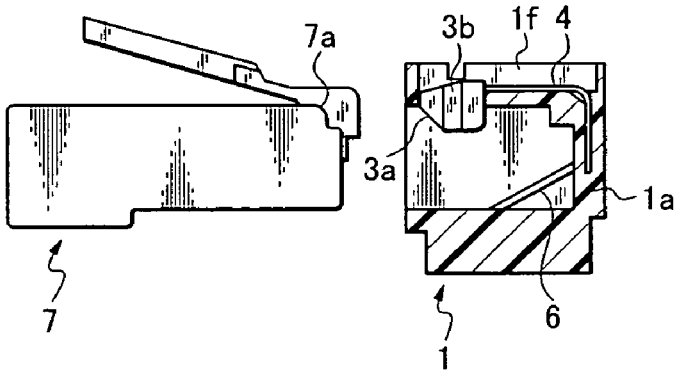
FIGS. 6A and 6B are left side and front longitudinal sectional views, respectively showing a normal modular plug prior to insertion in the modular jack.
Figure 6B:
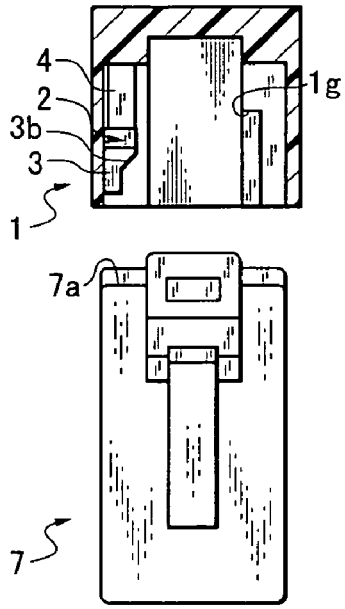
Figure 7A:
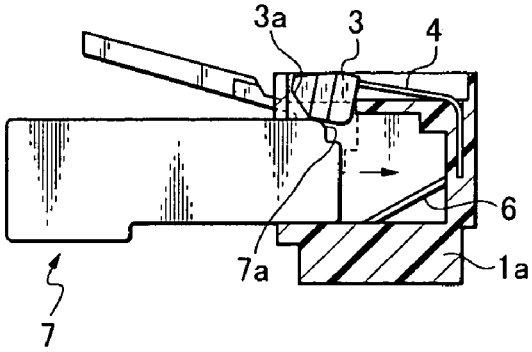
FIGS. 7A and 7B are left side and front longitudinal sectional views, respectively showing the normal modular plug in the process of being inserted in the modular jack.
Figure 7B:
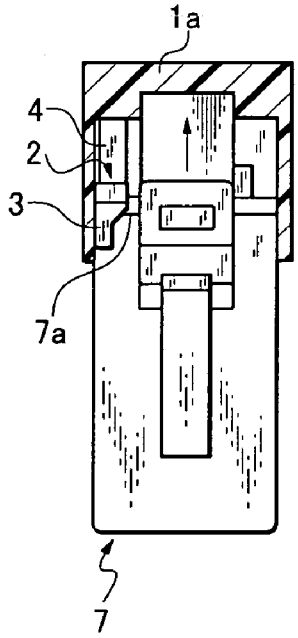
Figure 8A:
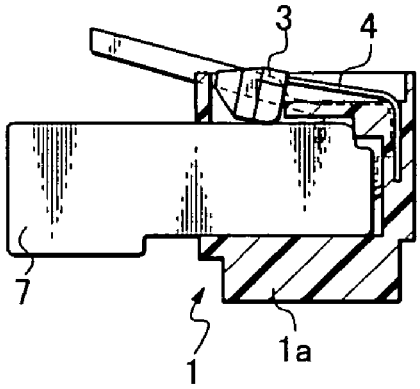
FIGS. 8A and 8B are left side and front longitudinal sectional views, respectively showing the normal modular plug completely inserted in the modular jack.
Figure 8B:
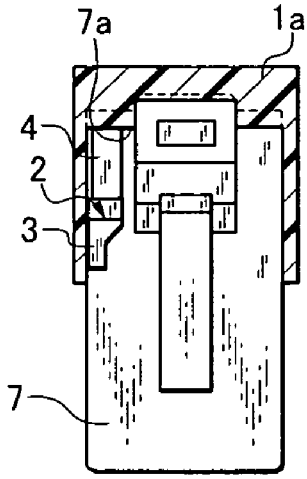
Figure 9:
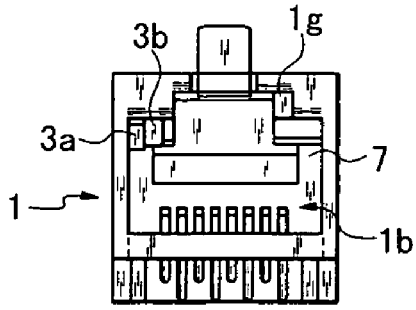
FIG. 9 is a front view showing the normal modular plug completely inserted in the modular jack.

With the modular jack 1 having the construction described above, as shown in FIGS. 6A and 6B, first, in a case in which a modular plug 7 of the same number of pins (8) is engaged, initially a shoulder portion 7*a* of the tip of the modular plug 7 contacts the slanted surface 3*a* of the mis-insertion prevention guide 3 as a mis-insertion determination member that projects into the interior space of the modular jack 1. Then, as shown in FIGS. 7A and 7B, the shoulder portion 7*a* of the modular plug 7 slides along the slanted surface 3*a* and advances into the interior of the housing 1*a* while pushing the mis-insertion prevention guide 3 up and out of the way, thus completing the insertion of the modular plug 7 into the modular jack 1 (see FIG. 8A, 8B and FIG. 9). Thus, when an 8-pin modular plug 7 is inserted into an 8-pin modular jack as described, the mis-insertion prevention guide 3 retreats upward due to the elasticity of the lever 4, and does not obstruct insertion of the modular plug 7 into the modular jack 1.

Figure 10A:
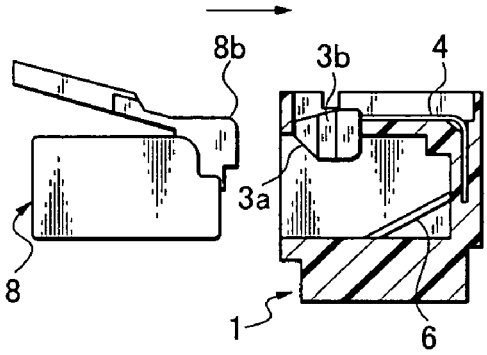
FIGS. 10A and 10B are left side and front longitudinal sectional views, respectively showing a modular plug of the wrong type prior to attempting to enter the modular jack.
Figure 10B:
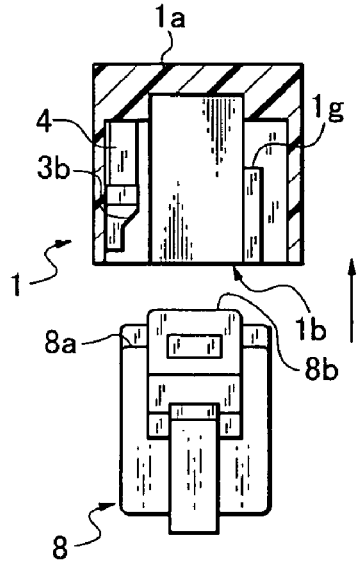
Figure 11A:
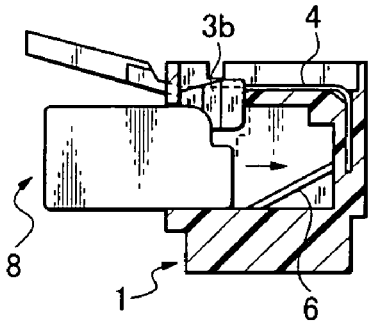
FIGS. 11A and 11B are left side and front longitudinal sectional views, respectively showing the modular plug of the wrong type entering the modular jack.
Figure 11B:
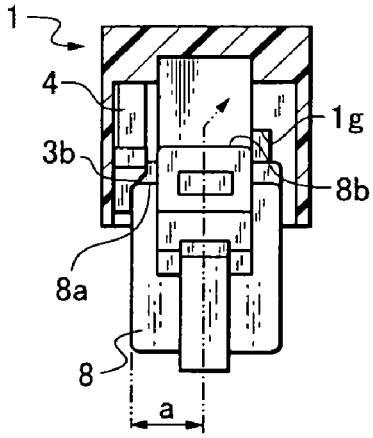
Figure 12A:
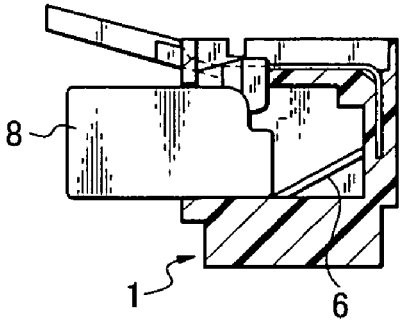
FIGS. 12A and 12B are left side and front longitudinal sectional views, respectively showing insertion of the modular plug of the wrong type in the modular jack being prevented.
Figure 12B:
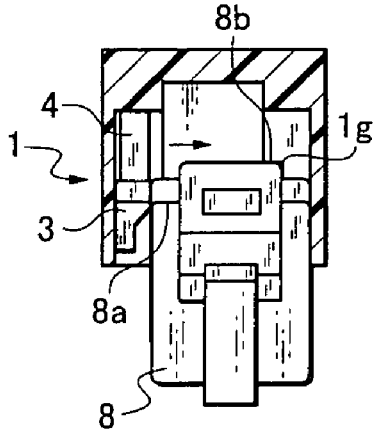
Figure 13A:
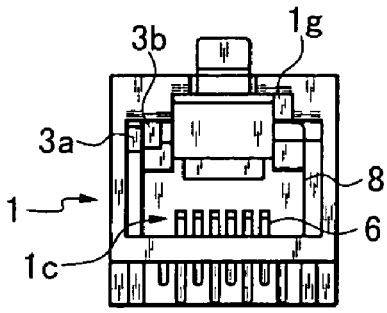
FIGS. 13A and 13B are front views showing states in which insertion of modular plugs of the wrong type in the modular jack is being prevented.
Figure 13B:
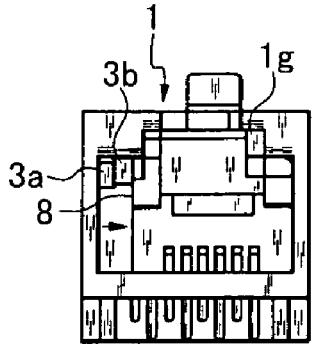

By contrast, as shown in FIGS. 10A and 10B, when a modular plug 8 having a different number of pins (6 or 4) from that of the 8-pin modular jack 1 is inserted into the opening 1*b* of the modular jack 1, as shown in FIGS. 11A and 11B a left side shoulder portion 8*a* of the tip of the modular plug 8 contacts the slanted surface of the traverse movement-including part 3*b* of the mis-insertion prevention guide 3 without first contacting the slanted surface 3*a* of the mis-insertion prevention guide 3 because a distance from the centerline axis of the modular plug 8 to the side of the modular plug 8 is shorter than the distance in the correct, 8-pin modular plug 7. Accordingly, as shown by the arrow shown in FIG. 11B, the modular plug 8 is induced by the slanted surface of the traverse movement-including part 3*b* to move diagonally to the right side, that is, the side opposite the side on which the mis-insertion prevention guide 3 is disposed.

When that happens, as shown in FIGS. 12*a* and 12B, and FIGS. 13A and 13B, an upper guide reception part 8*b* that is the upper corner of the modular plug 8 is induced to move to the right as it advances, contacts the stopper 1*g* on the roof of the housing 1*a* and stops. Thus, even if the modular plug 8, with the wrong number of pins for the modular jack 1, is inserted into the modular jack 1, it is stopped before it reaches the contact assembly 1*c* on the housing 1*a* side.

Thus, as described above, when a modular plug with the wrong number of pins for the modular jack 1 is mistakenly inserted into the modular jack 1, even if the technician does not realize it, the modular plug 8 is automatically moved laterally in one direction until a part of the modular plug 8 contacts the stopper 1*g* and any further advance of the modular plug 8 in the direction of insertion into the modular jack 1 is stopped. As a result, the technician is made aware of the mistaken insertion and a modular plug 7 of the correct number of pins is inserted into the modular jack 1. Accordingly, the object of the present invention is achieved by preparing the mis-insertion determination unit 2 as a single component separate from the housing 1*a*, resulting in a reduction in the cost of the modular jack 1.

It should be noted that, in the embodiment described above, the mis-insertion prevention unit comprising the mis-insertion prevention guide 3 and the lever 4 is provided at the upper left of the opening 1*b* in the housing 1*a* and the stopper 1*g* is positioned at the right rear inside the housing.

However, the present invention is not limited to such an arrangement, and therefore, as can be understood by those skilled in the art, the relative positions of the mis-insertion prevention guide 3 and the stopper 1*g* may be reversed and still achieve the effect of the invention.

As many apparently widely different embodiments of the present invention can be made without departing from the spirit and scope thereof, it is to be understood that the invention is not limited to the specific embodiment thereof and described herein except as defined in the appended claims.

What is claimed is:

1. A modular jack having a mis-insertion prevention mechanism that prevents insertion of a modular plug having a number of pins other than a predetermined number of pins, the mis-insertion prevention mechanism comprising a mis-insertion determination unit and a stopper, the mis-insertion determination unit comprising a mis-insertion prevention guide mounted at the front of the mis-insertion determination unit that causes a modular plug having a different number of pins from the modular jack inserted into an opening in a housing of the modular jack to move traversely and an elastic support mounted at the rear of the mis-insertion determination unit that is fixedly supported at the rear of the housing of the modular jack, the mis-insertion determination unit disposed on either an upper left or an upper right top part inside the opening in the housing of the modular jack, the stopper formed on a portion of the roof of the housing on a side opposite the side on which the mis-insertion determination unit is disposed in a lateral direction of the opening, the mis-insertion prevention mechanism preventing advance of a modular plug having a different number of pins from the modular jack mistakenly inserted into the opening in the housing of the modular jack beyond a point at which a portion of the modular plug contacts the stopper.

2. A modular jack according to claim 1, wherein a slanted surface is formed on a lower part of the tip of the mis-insertion prevention guide that allows the mis-insertion prevention guide to retreat upward when a modular plug having a predetermined number of pins is inserted into the housing of the modular jack and an upper part of a tip thereof slidingly contacts the mis-insertion prevention guide; and a traverse movement-including part is formed on a lateral surface of the mis-insertion prevention guide that slants inward toward the center of the housing of the modular jack in a latitudinal direction so that the tip of a modular plug having a different number of pins from the modular jack mistakenly inserted into the modular jack slides thereon and contacts against the stopper.

* * * * *